US012514333B1

(12) United States Patent
Egozi et al.

(10) Patent No.: US 12,514,333 B1
(45) Date of Patent: Jan. 6, 2026

(54) INSERTABLE ADAPTORS AND ADJUSTABLE CUSHIONING SHOE HEEL

(71) Applicant: THERAFIT FOOTWEAR, LLC, Miami Gardens, FL (US)

(72) Inventors: Moises Egozi, Miami Gardens, FL (US); William T. Anderson, Miami Gardens, FL (US)

(73) Assignee: THERAFIT FOOTWEAR, LLC, Miami Gardens, FL (US)

( * ) Notice: Subject to any disclaimer, the term of this patent is extended or adjusted under 35 U.S.C. 154(b) by 0 days.

(21) Appl. No.: 18/115,256

(22) Filed: Feb. 28, 2023

Related U.S. Application Data

(60) Continuation of application No. 15/929,334, filed on Apr. 27, 2020, now abandoned, which is a continuation of application No. 29/636,456, filed on Feb. 8, 2018, now Pat. No. Des. 882,220, which is a continuation of application No. 29/624,767, filed on Nov. 3, 2017, now abandoned, which is a division of application No. 29/525,713, filed on May 1, 2015, now Pat. No. Des. 801,649, which is a continuation-in-part of application No. 13/899,547, filed on May 21, 2013, now abandoned.

(60) Provisional application No. 61/650,024, filed on May 22, 2012.

(51) Int. Cl.

| | |
|---|---|
| ***A43B 13/18*** | (2006.01) |
| ***A43B 3/00*** | (2022.01) |
| ***A43B 13/12*** | (2006.01) |
| ***A43B 21/26*** | (2006.01) |
| ***A43B 21/42*** | (2006.01) |

(52) U.S. Cl.
CPC ..... *A43B 21/42* (2013.01); *A43B 3/0031* (2013.01); *A43B 13/125* (2013.01); *A43B 21/26* (2013.01)

(58) Field of Classification Search
None
See application file for complete search history.

(56) References Cited

U.S. PATENT DOCUMENTS

| | | | | |
|---|---|---|---|---|
| 3,785,646 A * | 1/1974 | Ruskin | A63B 21/4015 482/79 |
| 4,430,810 A * | 2/1984 | Bente | A43B 13/14 482/14 |
| 4,445,284 A * | 5/1984 | Sakutori | A43B 7/081 36/28 |
| 4,864,738 A * | 9/1989 | Horovitz | A43B 13/20 2/413 |

(Continued)

*Primary Examiner* — Jila M Mohandesi
(74) *Attorney, Agent, or Firm* — Polley IP Law, P.A.

(57) ABSTRACT

One or more adapters that can be removably inserted within horizontally oriented holes/passageways in the heel area of a shoe are disclosed. The adapters allow the shoe wearer to personally adjust the cushioning impact of the heel area of the shoe. Each adapter can have a tapered shape at one end. A thinner knob on the tapered end allows the adapter to snap or properly release into position with respect to the shoe heel once such end exits out of the corresponding heel passageway. The adapter can be constructed from dual density materials such that the tapered end can be softer to permit it to travel through the heel passageway easier. The outside of the adapter can be of a slightly harder material to provide extra support to the main heel strike area.

15 Claims, 5 Drawing Sheets

(56) References Cited

U.S. PATENT DOCUMENTS

| | | | | | |
|---|---|---|---|---|---|
| 5,195,256 | A * | 3/1993 | Kim | A43B 23/24 | 36/35 B |
| 5,406,719 | A * | 4/1995 | Potter | A43B 13/203 | 36/28 |
| 5,778,560 | A * | 7/1998 | Danieli | A43B 5/00 | 36/144 |
| 5,907,911 | A * | 6/1999 | Huang | A43B 13/203 | 36/71 |
| 5,983,529 | A * | 11/1999 | Serna | A43B 13/10 | 36/28 |
| 6,807,753 | B2 * | 10/2004 | Steszyn | A43B 3/0031 | 36/25 R |
| 6,983,553 | B2 * | 1/2006 | Lussier | A43B 3/24 | 36/27 |
| 7,162,815 | B2 * | 1/2007 | Miyauchi | A43B 13/181 | 36/31 |
| 2007/0113425 | A1 * | 5/2007 | Wakley | A43B 13/20 | 36/28 |

* cited by examiner

INSERTABLE ADAPTORS AND ADJUSTABLE CUSHIONING SHOE HEEL

This application is a continuation of U.S. application Ser. No. 15/929,334, filed Apr. 27, 2020, which is a continuation of U.S. application Ser. No. 29/636,456, filed Feb. 8, 2018, now U.S. Design Pat. No. D882,220, which is a continuation of U.S. application Ser. No. 29/624,767, filed Nov. 3, 2017, which is a divisional of U.S. application Ser. No. 29/525,713, filed May 1, 2015, now U.S. Design Pat. No. D801,649, which is a continuation-in-part of U.S. application Ser. No. 13/899,547, filed May 21, 2013, which application claims priority to and the benefit of U.S. Application Ser. No. 61/650,024, filed May 22, 2012, with all of the above-identified applications incorporated by reference in their entireties for all intended purposes.

1. FIELD OF THE DISCLOSURE

The present invention relates generally to shoes and particularly to a mechanism for personally adjusting the impact cushioning of a heel area for a shoe.

2. BACKGROUND OF THE DISCLOSURE

Conventional sneakers typically provide for a heel area having a set non-adjustable cushioning level. The present invention is directed to allowing a wearer of a sneaker to be able to adjust the cushioning impact of the heel area of the sneaker.

SUMMARY OF THE DISCLOSURE

The present disclosure describes one or more novel adapters that can be removably inserted within a substantially horizontally oriented hole/passageway in the heel area of a shoe. In a preferred embodiment, the shoe is a sneaker, though such is not considered limiting and other types of shoes and footwear having heels can be used and are considered within the scope of the invention. The adapter is preferably provided to allow the wearer to personally adjust the cushioning impact of the heel area of his or her shoe, when the wearer is walking or running. Preferably, a plurality of passageways can be provided in the shoe heel, and one or more adapters can be used depending on the desired cushioning.

Preferably, each adapter can have a tapered shape at one end. The thinner knob on the tapered end allows the adapter to snap or properly release into position with respect to the shoe heel once the end exits out of the heel passageway. The adapter can be constructed from dual density materials such that the tapered end can be softer to permit it to travel through the heel passageway easier. The outside of the adapter can be of a slightly harder material to provide extra support to the main heel strike area.

With use of one or more adapters, the wearer is permitted to personalize their comfort as they can choose the amount of shock absorbed by their feet. By inserting none, one, two, three or a plurality of adapters into corresponding heel passageways, the wearer can set their comfort level to fit their needs and to provide the support they desire. The adapters can be a one-piece adapters.

3. BRIEF DESCRIPTION OF THE DRAWINGS

Figure 3:
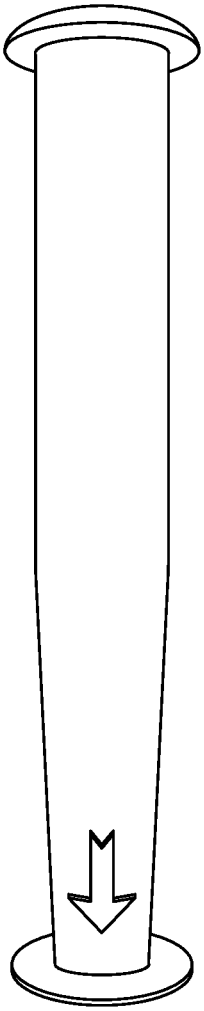
FIG. 3 is a front view of the heel insertable adapter in accordance with the present disclosure.
Figure 5:
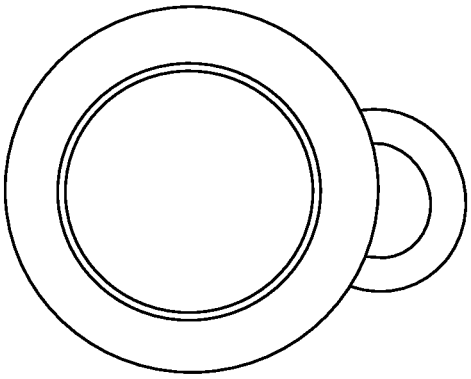
Figure 6:
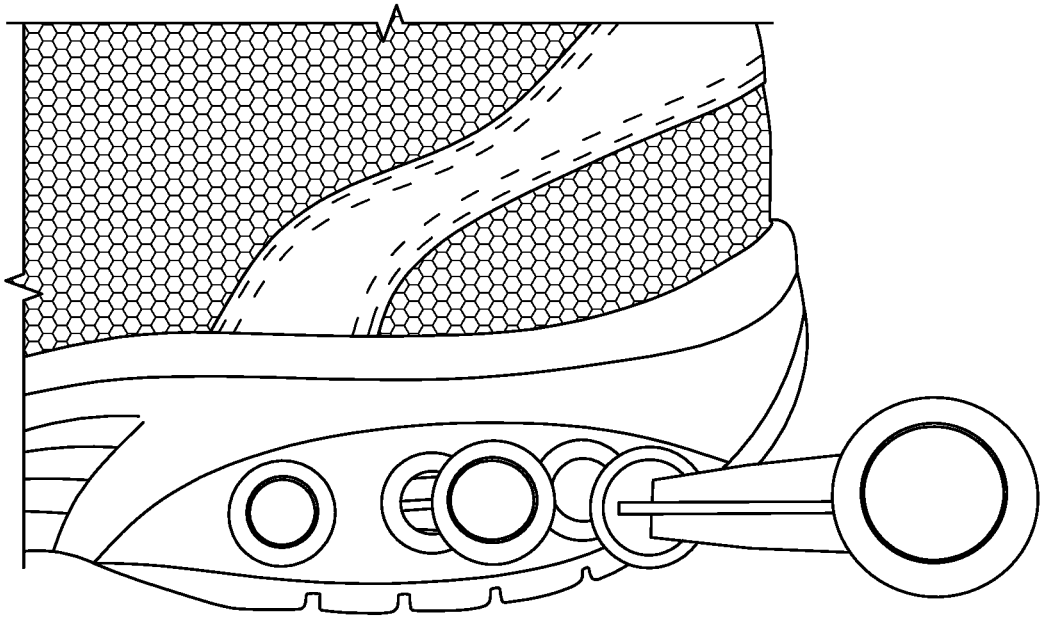

FIG. 5 is an opposite side view of the heel insertable adapter of FIG. 3; and FIG. 6 is a partial perspective view of the heel area of a sneaker showing one adapter fully inserted in a corresponding wedge passageway, a second adapter partially inserted in a corresponding second wedge passageway and a third uninserted adapter position adjacent to a corresponding third wedge passageway in accordance with the present disclosure.

4. DETAILED DESCRIPTION

Figure 1:
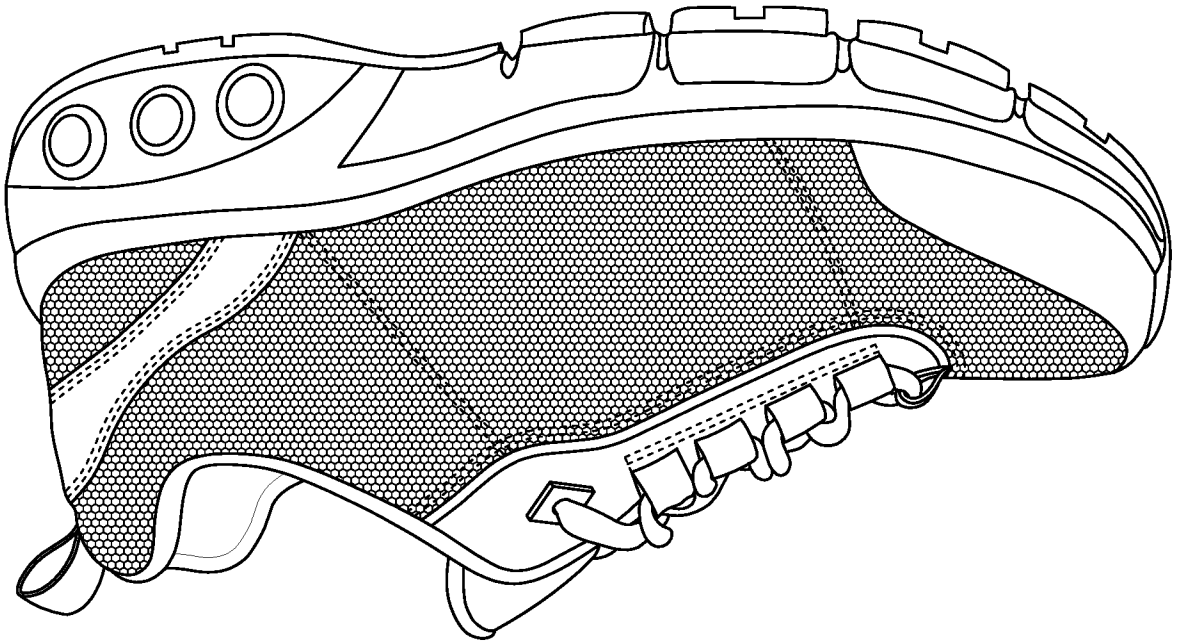
FIG. 1 is a perspective view of a sneaker having three adapters incorporated into a wedge portion of the sneaker's heel area in accordance with the present disclosure.
Figure 2:
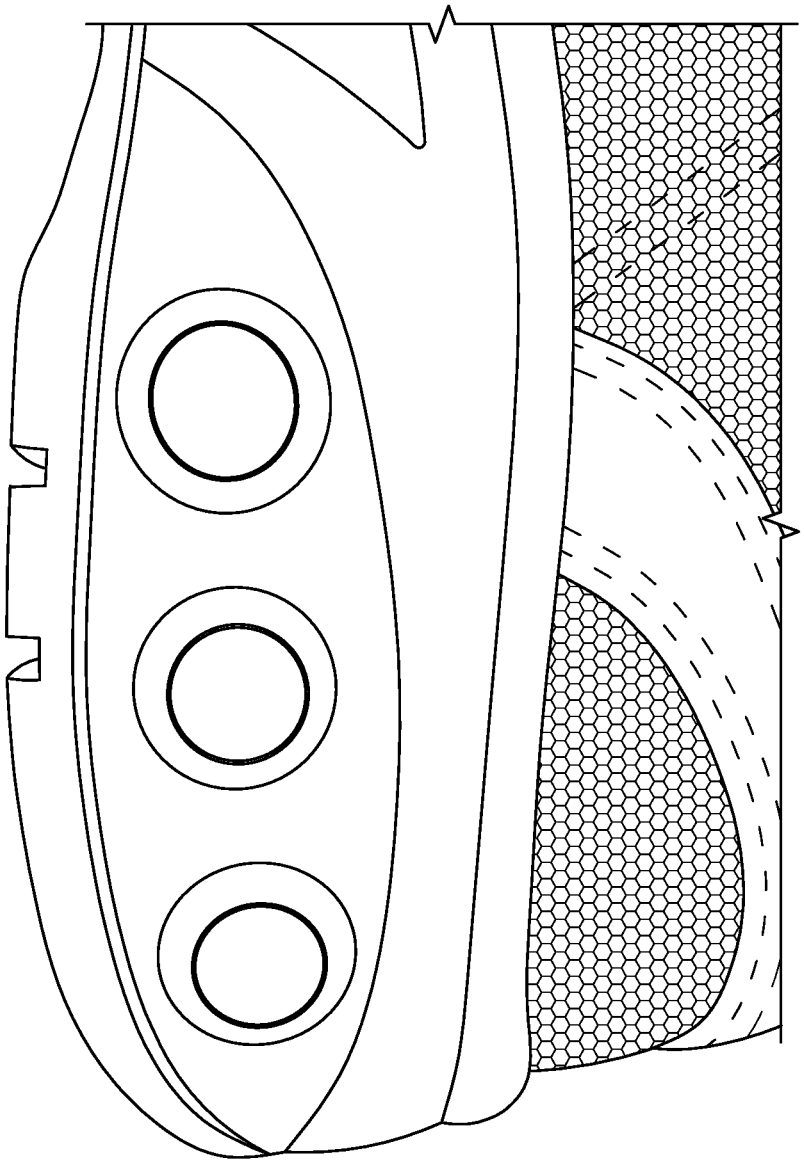
FIG. 2 is a close-up partial perspective view of the wedge/adapters of FIG. 1.

As seen in the Figures, the disclosure describes one or more novel adapters that are removably inserted within substantially horizontally oriented hole(s)/passageway(s) in the heel area of a shoe and preferably within a wedge portion of the outer sole of a shoe such as, but not limited to, a sneaker. By using one or more adapters, the wearer can personally adjust the cushioning impact of the heel area of the shoe. Though not considered limiting, preferably, a plurality of passageways can be provided in the shoe heel, and one or more adapters can be used depending on the desired cushioning (See FIGS. 1, 2 and 6).

Figure 4:
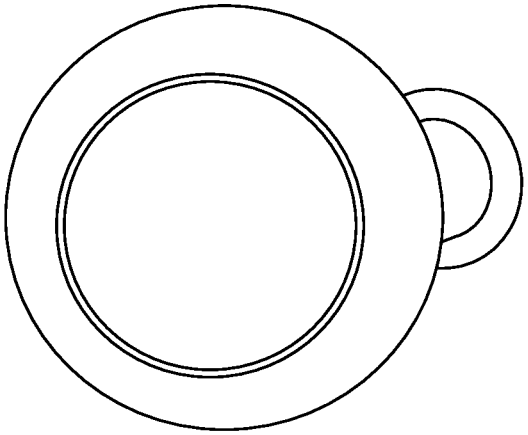
FIG. 4 is a first side view of the heel insertable adapter of FIG. 3.

The adapter is best seen in FIGS. 3, 4 and 5. Each adapter can have a tapered shape at one end. A thinner knob can be provided on the tapered end to allow the adapter to snap or properly release into position with respect to the shoe heel once such end exits out of the heel passageway. The adapter can be constructed from dual density materials such that the tapered end can be softer to permit it to travel through the heel passageway easier. The outside of the adapter can be of a slightly harder material to provide extra support to the main heel strike area.

In one non limiting embodiment, the hardness at the tapered end knob of the adapter can preferably be anywhere within the range of 40 Durometer or approximately 40 Durometer to 50 Durometer or approximately 50 Durometer and the hardness of the remaining portion of the adapter (elongated portion and opposite end knob) can preferably be anywhere within the range of 85 Durometer or approximately 85 Durometer to 95 Durometer or approximately 95 Durometer.

With use of one or more adapters disposed within corresponding heel passageways, the wearer is permitted to personalize their comfort as they can choose the amount of shock absorbed by their feet. By inserting none, one, two, three or a plurality of adapters into corresponding heel passageways, the wearer can set their comfort level to fit their needs and to provide the support they desire.

The novel tapered end of the adapter permits for a snap-in feature in view of the thinner inner wall on the tapered end of the plug, thus, allowing it to spring open over the hole of the passageway with the knobs on both ends larger in diameter than the passageway diameter. Therefore, the knobs on each end of the adapter serve to lock and maintain the adapter in its inserted position within a corresponding passageway.

Preferably, the adapter is constructed from a polyurethane material, though such is not considered limiting. The polyurethane material can be harder on the outside of the heel where the heel hits the ground and softer on the inside where there is less impact with the ground. Thus, preferably, the adapter can be a dual density adapter constructed of polyurethane with varying hardness.

When positioning the adapter within a corresponding passageway, the knob at the tapered end bends or folds inward when inserted in the first end of the heel passageway and maintains the bent inward configuration while traveling through the passageway. Once the inserted end reaches the end of the passageway it springs to its open/unfolded position upon coming out of the passageway.

The adapter functions properly regardless of which end of the passageway is chosen to be the insertion end. However, in one insertion method, the insertion end of the adapter is inserted initially at the end of the passageway that would be considered the outer end of the passageway when the shoe (i.e. sneaker, etc.) is worn by the wearer.

Maximum softness at the heel area is provided when no adapters are inserted. The present invention is not limited to any specific passageway(s) being required to be used when less than the maximum number of adapters are used. Every configuration (i.e. one adaptor in first passageway, one adaptor in second passageway, one adaptor in third passageway, two adaptors in first and second passageways, two adaptors in second and third passageways, two adaptors in first and third passageways) will provide a different cushioning/impact effect and all are considered within the scope of the invention. Thus, the user can personally adjust the desired amount of cushioning to his or her choosing.

Certain novel features, benefits and/or advantages of the present invention adapter, include, but are not limited to the following:

(a) the tapered shape of the adapter;

(b) the "thinner" knob on the tapered end that allows the adapter to "snap" into place when the adapter reaches the inside of the heel.

(c) the dual density, as the tapered end is softer to allow it to go through the heel better and the outside is slightly harder to give extra support to the main heel strike area.

All measurements, dimensions, amounts, sizes, shapes, percentages, configurations, securement or attachment mechanisms, numbers, ranges, values, percentages, materials, orientations, methods of manufacture, etc. discussed above or shown in the figures are merely by way of example and are not considered limiting and other measurements, dimensions, amounts, sizes, shapes, percentages, configurations, securement or attachment mechanisms, numbers, ranges, values, percentages, materials, orientations, methods of manufacture, etc. can be chosen and used and all are considered within the scope of the disclosure.

Dimensions of certain parts as shown in the drawings may have been modified and/or exaggerated for the purpose of clarity of illustration and are not considered limiting. Component values shown in the drawings, are merely examples of component values and part numbers that can be used and the present invention is not considered limited to these specific component values and part numbers.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic (s) or function(s) to be included for the claim element, claim step or claim term in the claim for examination purposes and when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the device has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

What is claimed is:

1. A combination heel and adapter for a shoe comprising:

a heel having a first side and a second side, said heel defining at least one passageway therethrough extending from the first side to the second side, each passageway of the at least one passageway having an inner diameter; and at least one one-piece adapter adapted for removable insertion within the passageway of said heel, each adaptor of the at least one adaptor comprising an elongated member having a first end and a second end, a first knob formed at the first end of the elongated member and a second knob formed at the second end of the elongated member, said first knob and said second knob having outer diameters that are larger in size than an outer diameter of the elongated member, the outer diameter of the first knob and the outer diameter of the second knob both being larger than the inner diameter of each passageway of the at least one passageway such that when the elongated member is disposed within a passageway of the at least one passageway the first knob extends out of a first end of the passageway and beyond a perimeter of the passageway at the first end of the passageway and the second knob extends out of a second end of the passageway and beyond a perimeter of the passageway at the second end of the passageway and the larger outer diameter size of the first knob and the larger outer diameter size of the second knob with respect to the inner diameter size of the passageway cause the first knob and the second knob to maintain the position of the elongated member within the passageway; wherein each passageway extending from an outermost point of the first side of said heel to an outermost point of the second side of said heel.

2. The combination heel and adapter for a shoe of claim 1 wherein said at least one one-piece adapter comprising three one-piece adaptors and said at least one passageway comprising three passageways.

3. The combination heel and adapter for a shoe of claim 1 wherein said at least one passageway is substantially horizontally oriented when said heel is formed as part of a shoe.

4. The combination heel and adapter for a shoe of claim 1 wherein each one-piece adapter is constructed from a polyurethane material.

5. The combination heel and adapter for a shoe of claim 4 wherein a first polyurethane material is used for an outside area of the elongated member for each one-piece adapter and a second polyurethane material is used for inside of the elongated member for each one-piece adapter.

6. The combination heel and adapter for a shoe of claim 5 wherein said first polyurethane material is a harder material as compared to the second polyurethane material.

7. The combination heel and adapter for a shoe of claim 6 wherein each adaptor is a dual density adapter constructed of polyurethane with varying hardness.

8. The combination heel and adapter for a shoe of claim 1 wherein said first knob is thinner in size as compared to a size of said second knob and the first knob is constructed from a softer material than a material used for constructing the second knob.

9. A combination heel and adapter for a shoe comprising:

a heel having a first side and a second side, said heel defining at least one passageway therethrough extending from the first side to the second side, each passageway of the at least one passageway having an inner diameter; and at least one one-piece adapter adapted for removable insertion within the passageway of said heel, each adaptor of the at least one adaptor comprising a fixed size elongated member having a first end and a second end, a first knob formed at the first end of the elongated member and a second knob formed at the second end of the elongated member, said first knob and said second knob having outer diameters that are larger in size than an outer diameter of the elongated member, the outer diameter of the first knob and the outer diameter of the second knob both being larger than the inner diameter of each passageway of the at least one passageway such that when the elongated member is disposed within a passageway of the at least one passageway the first knob extends out of a first end of the passageway and beyond a perimeter of the passageway at the first end of the passageway and the second knob extends out of a second end of the passageway and beyond a perimeter of the passageway at the second end of the passageway and the larger outer diameter size of the first knob and the larger outer diameter size of the second knob with respect to the inner diameter size of the passageway cause the first knob and the second knob to maintain the position of the elongated member within the passageway; wherein said elongated member having a tapering portion terminating at said first end such that the outer diameter of said elongated member at the first end prior to reaching the first knob is smaller than a diameter of said elongated member at the second end prior to reaching the second knob such that an outer diameter size for the elongated member is not uniform.

10. The combination heel and adapter for a shoe of claim 9 wherein said first knob is thinner in size as compared to a size of said second knob and the first knob is constructed from a softer material than a material used for constructing the second knob.

11. The combination heel and adapter for a shoe of claim 9 wherein the elongated member for each of said one-piece adaptors is constructed from dual density materials with an outer surface portion of the elongated member is constructed from a first material and an inside portion of the elongated member is constructed from a second material with the first material being harder than the second material.

12. The combination heel and adapter for a shoe of claim 9 wherein said at least one one-piece adapter comprising three one-piece adaptors and said at least one passageway comprising three passageways.

13. The combination heel and adapter for a shoe of claim 9 wherein said at least one passageway is substantially horizontally oriented when said heel is formed as part of a shoe.

14. A method for adjusting the cushioning of a shoe heel by removably securing a one-piece adaptor within the shoe heel, said adaptor having an elongated member, a first knob formed at a first end of the elongated member and a second knob formed at a second end of the elongated member, said first knob and said second knob having outer diameters that are larger in size than an outer diameter of the elongated member, said method comprising the steps of:

(a) providing at least one passageway extending from a first side of a shoe heel to a second side of the shoe heel member with the passageway having an inner diameter that is smaller than outer diameters of both the first knob and the second knob;

(b) bending the first knob of the one-piece adaptor such that the first knob fits within the passageway;

(c) inserting the bent first knob of the one-piece adaptor into a first end of the passageway and all the way through the passageway such that the first knob exits out of the second end of the passageway and returns to an unbent position wherein at such point the first knob is disposed out of the passageway at the second opposite end of the passageway and extends beyond a perimeter of the passageway at the second end of the passageway and the second knob is disposed out of the passageway at the first end of the passageway and extends beyond a perimeter of the passageway at the first end of the passageway; and (d) maintaining the elongated member of the one-piece adapter in place within the passageway by the outer diameter of the first knob and the outer diameter of the second knob being larger in size than the diameter of the passageway such that the first knob extends beyond the perimeter at the second end of the passageway and serves as a first stop member at the second end of the passageway and the second knob extends beyond the perimeter of the first end of the passageway and serves as a second stop member at the first end of the passageway.

15. The method for adjusting the cushioning of a shoe heel of claim 14 wherein the elongated member having a tapering portion terminating at said first end such that a diameter of said elongated member at the first end prior to reaching the first knob is smaller than a diameter of said elongated member at the second end prior to reaching the second knob such that an outer diameter size for the elongated member is not uniform.

* * * * *